US006481574B1

(12) United States Patent
Pakosh

(10) Patent No.: US 6,481,574 B1
(45) Date of Patent: Nov. 19, 2002

(54) LUGGAGE HAVING ENHANCED CLOTHING AND ACCOUTERMENT CARRYING CAPABILITIES IN AN ACCESSIBLE CONFIGURATION

(76) Inventor: Donald P. Pakosh, 29 Clancy Lane Estates, Rancho Mirage, CA (US) 92270

( * ) Notice: Subject to any disclaimer, the term of this patent is extended or adjusted under 35 U.S.C. 154(b) by 0 days.

(21) Appl. No.: 09/805,065

(22) Filed: Mar. 12, 2001

(51) Int. Cl.[7] ..... B65D 85/18

(52) U.S. Cl. ..... 206/285; 206/278; 206/286; 206/288; 206/291; 190/107; 190/127; 190/18 A; 190/110; 190/111

(58) Field of Search ..... 206/278, 284, 206/285, 287, 287.1, 289, 291, 290; 220/9.1, 9.2, 9.3; 190/127, 107, 18 A, 111, 110

(56) References Cited

U.S. PATENT DOCUMENTS 1,155,475 A * 10/1915 Fay ..... 220/9.3 X
1,948,019 A * 2/1934 Ballentine ..... 206/287
2,086,895 A * 7/1937 Cart ..... 206/287.1
2,645,541 A * 7/1953 Mintz et al. ..... 206/285
2,671,706 A * 3/1954 Greengold ..... 206/383
2,841,257 A * 7/1958 Dallas ..... 206/289
4,062,429 A * 12/1977 Tabor et al. ..... 190/18 A
4,453,623 A * 6/1984 Horii ..... 190/109 X
4,538,709 A * 9/1985 Williams et al. ..... 190/18 A
4,813,520 A * 3/1989 Lin ..... 190/18 A
5,060,795 A * 10/1991 Bomes et al. ..... 206/287
5,071,003 A * 12/1991 Freelander ..... 206/282
5,323,897 A * 6/1994 Sperber ..... 206/287
5,353,900 A * 10/1994 Stilley ..... 190/18 A

* cited by examiner

*Primary Examiner*—Lee Young
*Assistant Examiner*—Tri M. Mai
(74) *Attorney, Agent, or Firm*—Dorsey & Whitney LLP

(57) ABSTRACT

A piece of luggage for carrying clothing and accessories is disclosed. The luggage may be used to carry and store clothing on hangers together with accouterments in a convenient, vertically-accessible configuration.

57 Claims, 12 Drawing Sheets

38
40
40
102
42

94
11
89
14
82
64
70
74
83
46
80
44
86
84
32
30
66
90
68
78
8A
64
108
52
80
88
68
69
64
14
11
8A
80
87
10
10
64
97
98
92
96
16
100
16

64
80
97
96
98

78
70
46
76
64
74

46
70

LUGGAGE HAVING ENHANCED CLOTHING AND ACCOUTERMENT CARRYING CAPABILITIES IN AN ACCESSIBLE CONFIGURATION

BACKGROUND OF THE INVENTION a. Field of the Invention

The invention is directed toward a piece of luggage for carrying clothing and accessories. More specifically, it relates to a piece of luggage that may be used to carry both hanging clothes, as well as folded clothes, accessories, and shoes.

b. Background Art

It is well known to place clothing and accessories in a suitcase or other piece of luggage to facilitate transfer of the clothing and accessories from one location to another. It is also well known to travel with relatively large pieces of luggage or steamer trunks. Airlines, however, put limitations on the configuration and weight of luggage that they are willing to accept for transport. For example, some airlines will not transport items in excess of 115 linear inches (depth plus width plus height). Further, these same airlines require that no single dimension may be more than 62 inches. Although these airlines will accept items between 62 and 115 linear inches, there do so only after levying a surcharge. Presently, upon payment of a $50 surcharge or penalty, airlines will carry a bag domestically with dimensions that total 115 linear inches. In addition to dimensional limitations, these airlines put weight restrictions on luggage. Normally if a suitcase weights 70–100 lbs., the airlines will only transport the bag after collecting a surcharge. Presently, upon payment of a $50 surcharge or penalty, airlines will carry a bag domestically that weights 70–100 lbs. These airlines will not transport a bag weighing more than 100 lbs.

There remains a need for luggage that meets the airline luggage requirements while providing support for clothes on hangers in an easily accessible configuration.

BRIEF SUMMARY OF THE INVENTION

It is desirable to be able to store clothing on hangers together with accouterments in a convenient, vertically-accessible configuration. Accordingly, it is an object of the disclosed invention to provide an improved piece of luggage.

In a first form, the present invention comprises a piece of luggage for carrying clothing and accessories, the luggage having an interior and comprising a main frame assembly including a plurality of frame members, a main hanger bar, and a swingable frame support bar adapted to pivot between an open configuration and a supporting configuration; a hanger retention system connected to the main frame assembly; an outer skin supported on the main frame assembly, the outer skin comprising a front panel; and a side access panel comprising part of the outer skin and transformable between an open configuration and a closed configuration.

In a second form, the present invention comprises a piece of luggage for carrying clothing and accessories, the luggage having an interior and comprising a main frame assembly comprising a front frame member; a rear frame member; a main hanger bar extending between the front frame member and the rear frame member; a swingable frame support bar extending between the front frame member and the rear frame member, the swingable frame support bar being adapted to pivot between an open configuration and a supporting configuration; and a swing-out front door panel supported on a front door frame, the swing-out front door panel being adapted to swing between a closed configuration and an open configuration. In this form, the luggage also includes a hanger retention system connected to the main frame assembly adjacent to the main hanger bar; and an outer skin supported on the main frame assembly, the outer skin comprising a side access panel that is transformable between an open configuration and a closed configuration.

In a third form, the present invention comprises a piece of luggage for carrying clothing and accessories, the luggage having an interior and comprising a main frame assembly including a plurality of frame members, a main hanger bar, and a swingable frame support bar adapted to pivot between an open configuration and a supporting configuration; a hanger retention system connected to the main frame assembly; a plurality of shoe sleeves on a bottom panel in the interior of the luggage; and an outer skin supported on the main frame assembly. In this form, the outer skin comprises a shoe access panel, wherein the shoe access panel selectively covers the shoe sleeves; and a side access panel, wherein the side access panel is selectively configurable between an open configuration and a closed configuration.

The foregoing and other aspects, features, details, utilities, and advantages of the present invention will be apparent from reading the following description and claims, and from reviewing the accompanying drawings.

DESCRIPTION OF THE PREFERRED EMBODIMENTS

Two preferred embodiments of a piece of luggage 10 (e.g., FIG. 1), 10' (e.g., FIG. 20) having enhanced clothing and accouterment carrying capabilities according to the present invention are disclosed. An advantage of the instant invention over the prior art is that it permits a user to carry both hanging clothes, as well as folded clothes, accessories, and shoes conveniently and accessibly in a single piece of luggage. In its most basic form, the preferred embodiments of the present invention 10, 10' comprise a container or trunk for transporting clothing and accouterments in a traveling closet with a lateral cross-sectional shape that outlines and accommodates a man's or a woman's suit of clothing.

Figure 1:
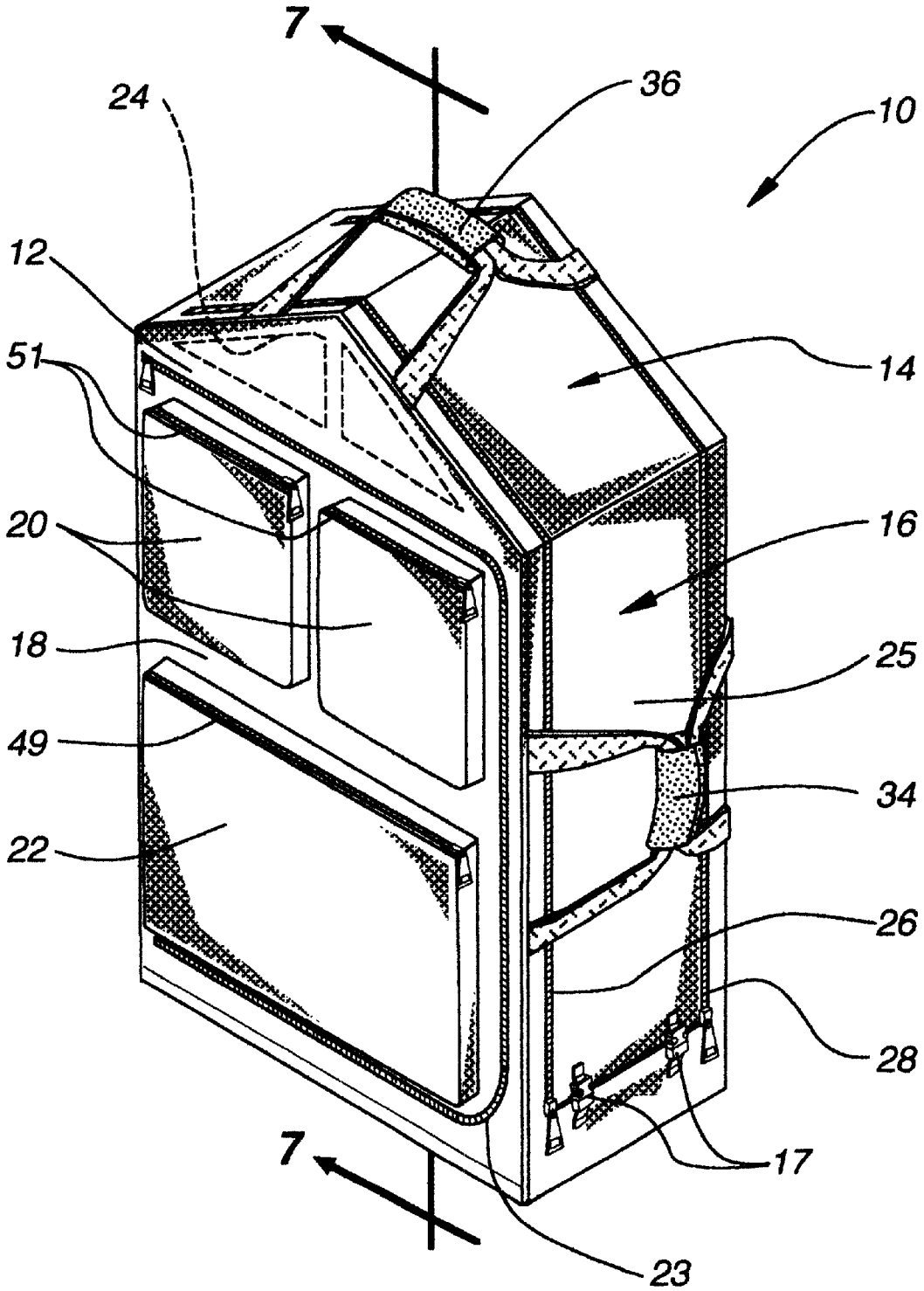
FIG. 1 is an isometric view looking downwardly at the front, top, and right side of a piece of luggage according to a first embodiment of the present invention depicted in its travel-ready configuration.
Figures 8, 8A, 8B, 9, 10:
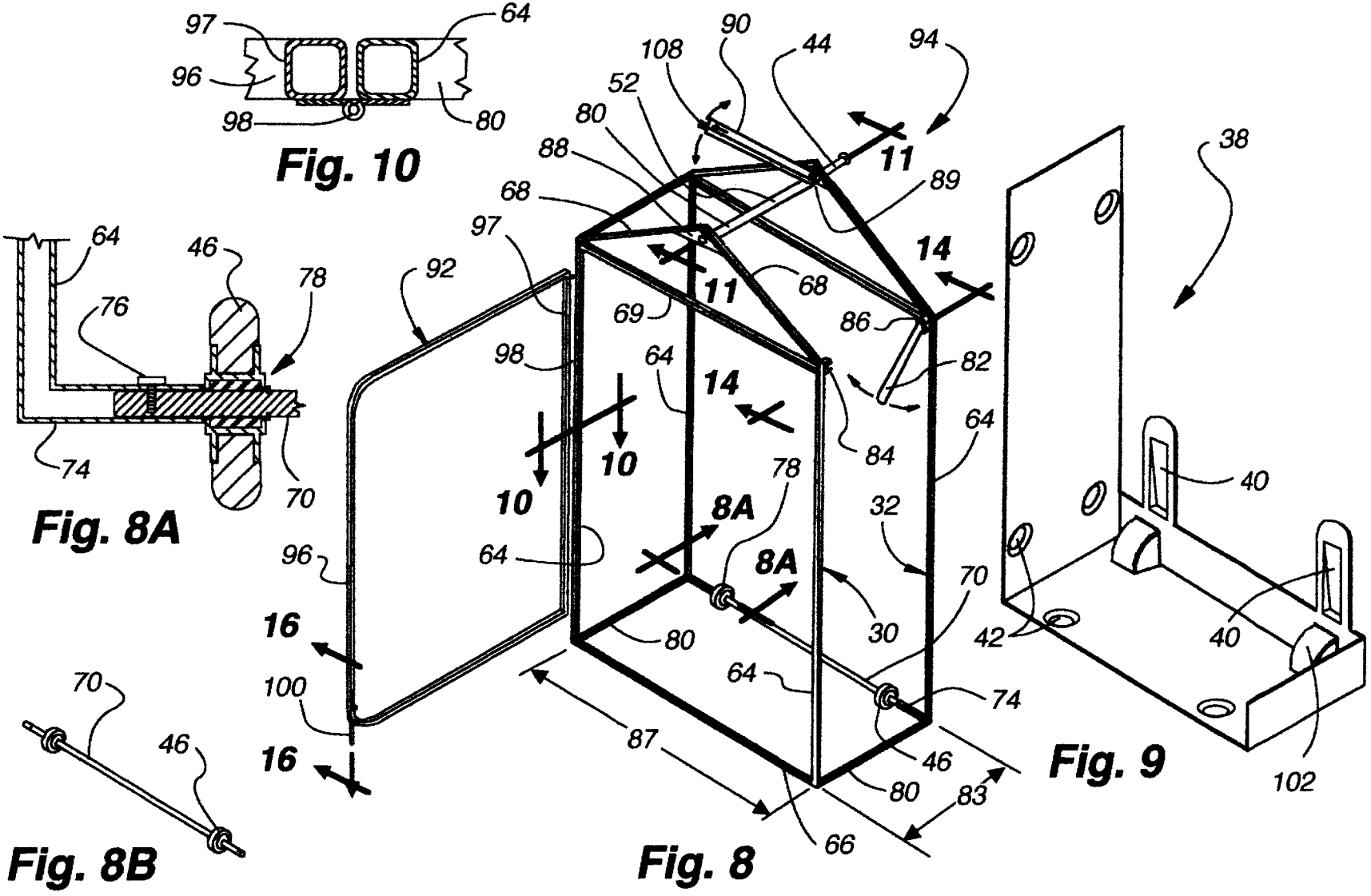
FIG. 8 is an isometric view of a main frame assembly that comprises part of the luggage according to the present invention.
FIG. 8A is a fragmentary cross-sectional view taken along line 8A—8A of FIG. 8 and depicting mounting of a wheel and a wheel axle.
FIG. 8B is an isometric view of the axle and wheels also depicted in FIG. 8, but shown separated from the main frame assembly.
FIG. 9 is an isometric view of a molded component that comprises part of the luggage according to the present invention as depicted in, for example, FIGS. 1–7.
FIG. 10 is a fragmentary, cross-sectional view taken along line 10—10 of FIG. 8, depicting some frame members and a piano hinge that swingably supports a front door frame.

Referring to FIGS. 1–19, the first preferred embodiment of the present invention 10 is described next. FIG. 1 is an isometric view looking downwardly at the front 12, top 14, and right side 16 of a piece of luggage according to the first preferred embodiment of the present invention. In FIG. 1, the luggage is shown in its travel-ready configuration. In this embodiment, a zippered front door panel 18 includes two dual-access intermediate pockets 20 and one dual-access large bottom pocket 22. As discussed further below, the zippered front door panel 18 is retained in the closed configuration depicted in FIG. 1 by a long curved zipper 23. One or more ski-boot-type closing clamps (not shown) may also be present inside the luggage to further secure the front door frame 92 to the front frame member 30 (FIG. 8). Two single access interior pockets 24 are shown in phantom on FIG. 1.

In this first preferred embodiment, the outer periphery of the luggage is pentagonal or house-shaped in the plane containing line 7—7 that is also parallel to the front panel 12. This configuration accommodates a man's or woman's suit of clothing. The luggage 10 includes a zippered side access panel 25, which permits the traveler to easily access the clothes hanging inside of the luggage making is unnecessary to unpack the luggage as must be done with a typical suitcase. As described further below, a pair of preferably straight zippers, including a front closure zipper 26 and a rear closure zipper 28, keep the side access panel 25 in the closed configuration depicted in FIG. 1. Since the zippers 26, 28 are in the material that is inside of the front frame member 30 and the rear frame member 32 (FIG. 8), they preferably bear no weight. To help ensure that the side access panel 25 does not inadvertently open, one or more closure clips 17 may be added to the distal end of the side access panel 25. A lower separable handle 34 is attached along the right side of the luggage as depicted in FIG. 1, and an upper separable handle 36 is attached along the top surface 14 of the luggage 10.

Figure 2:
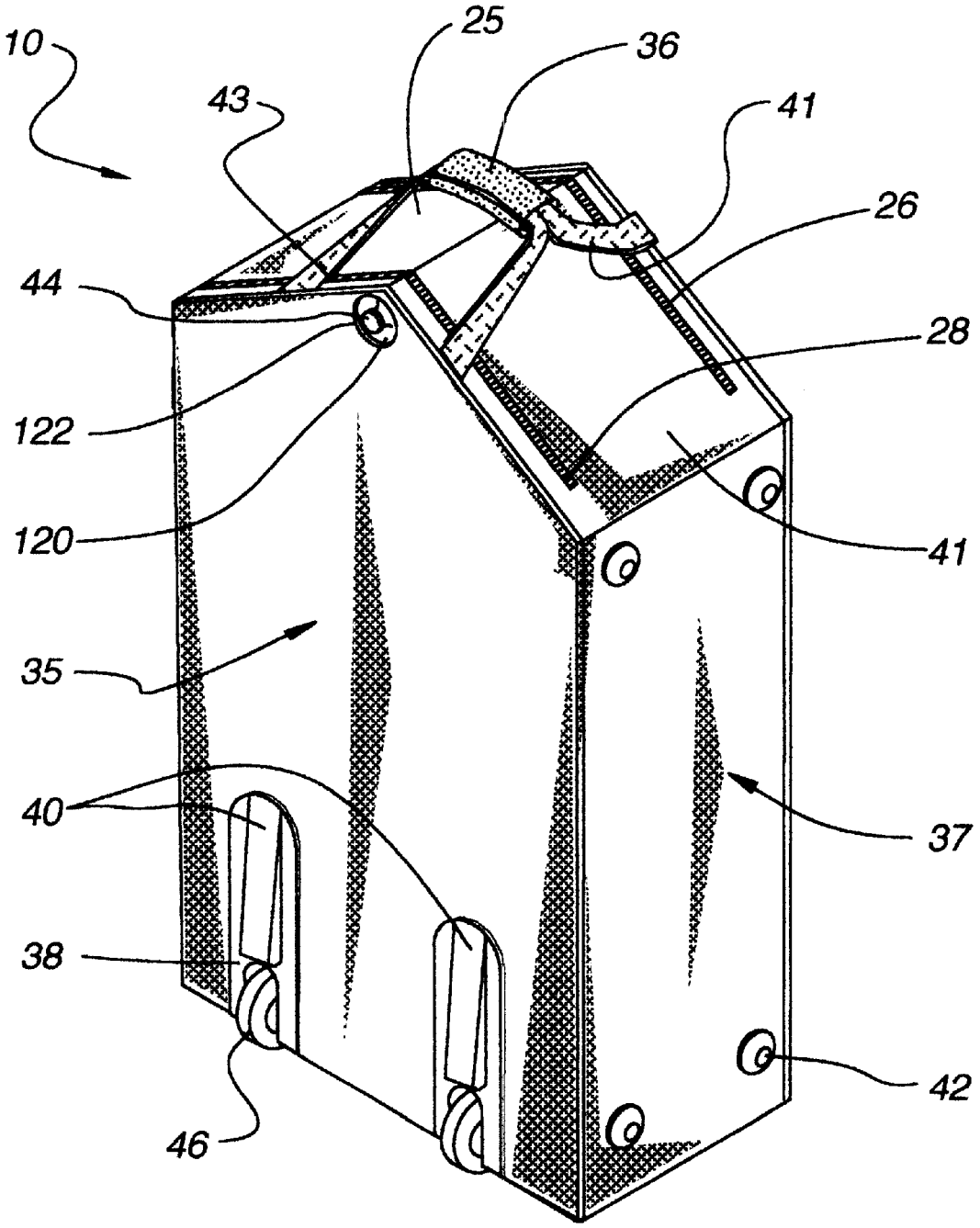
FIG. 2 is an isometric view of the luggage depicted in FIG. 1, looking downwardly at the rear, top, and left side of the luggage in its travel-ready configuration.
Figure 6:
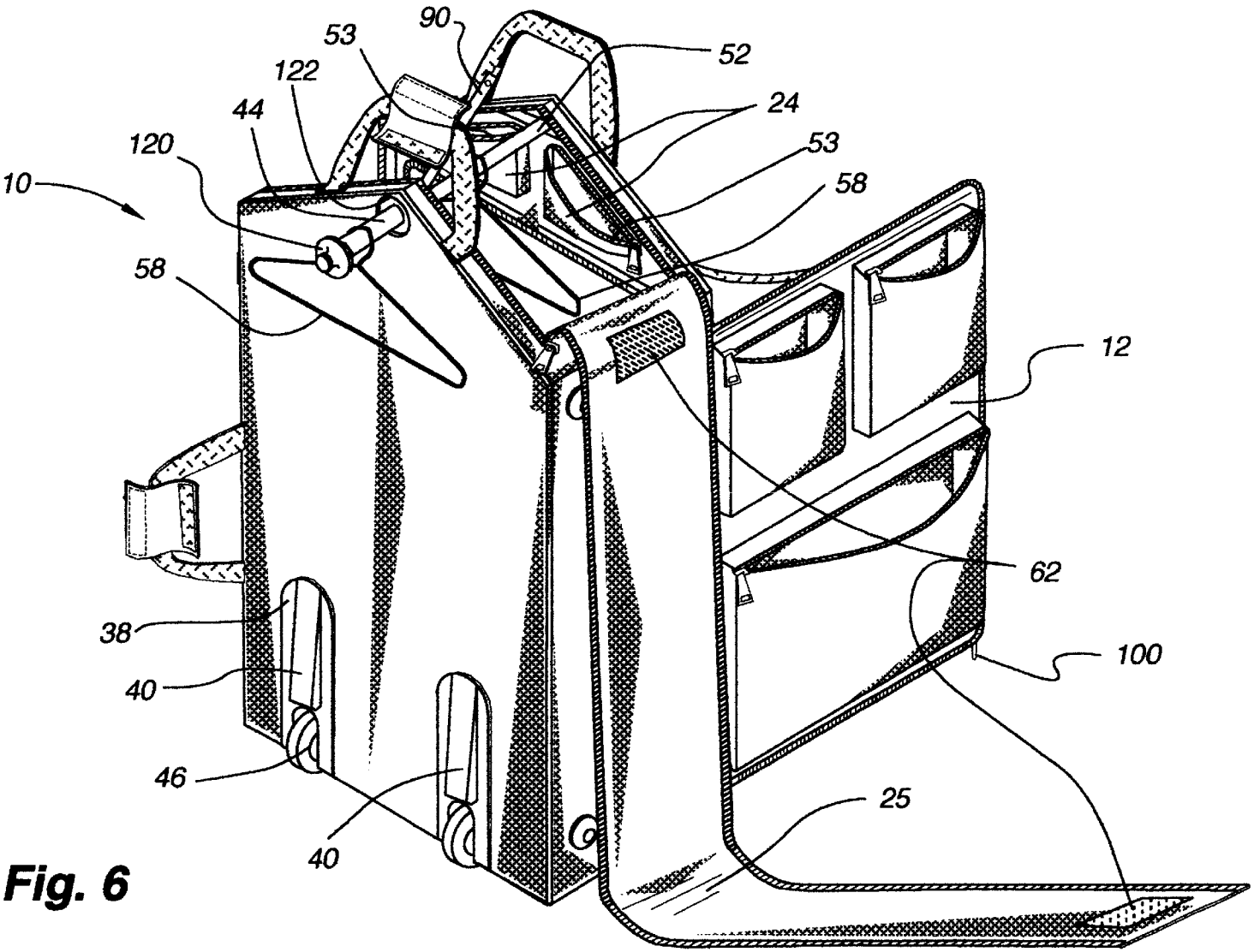
FIG. 6 is an isometric view of the luggage in the configuration depicted in FIG. 5, but showing the rear of the luggage with an auxiliary hanger bar in an extended configuration.

Referring most specifically to FIG. 2, which is an isometric view of the luggage 10 according to the first embodiment of the present invention looking downwardly at the rear 35, top 14, and left side 37 of the luggage 10 in its travel-ready configuration, additional features are described next. The luggage 10, which preferably includes an outer skin of fabric or other material may also comprise a molded component 38 (FIG. 9), which is partially visible in FIG. 2. In particular, the molded component 38 may include a pair of skids 40 that help reduce damage and wear on the outer skin of the luggage 10 when it is laid on its rear side 35. Further, the molded component 38 may include a plurality of molded feet 42 that project outwardly from one or more sides of the luggage 10. As shown in FIG. 2, four molded feet 42 may be present on the left side 37 of the luggage 10, and additional molded feet 42 may be present on another side (see, e.g., FIG. 9). Also depicted in FIG. 2, and as described more fully below in connection with, for example, FIG. 6, is the end of the auxiliary hanger bar 44 that is extendable from the rear side 35 of the luggage 10. As visible in FIG. 2, and as further discussed below in connection with FIGS. 8, 8A, and 8B, are the wheels 46 that permit easy transportation of the luggage 10 according to the present invention.

Figure 3:
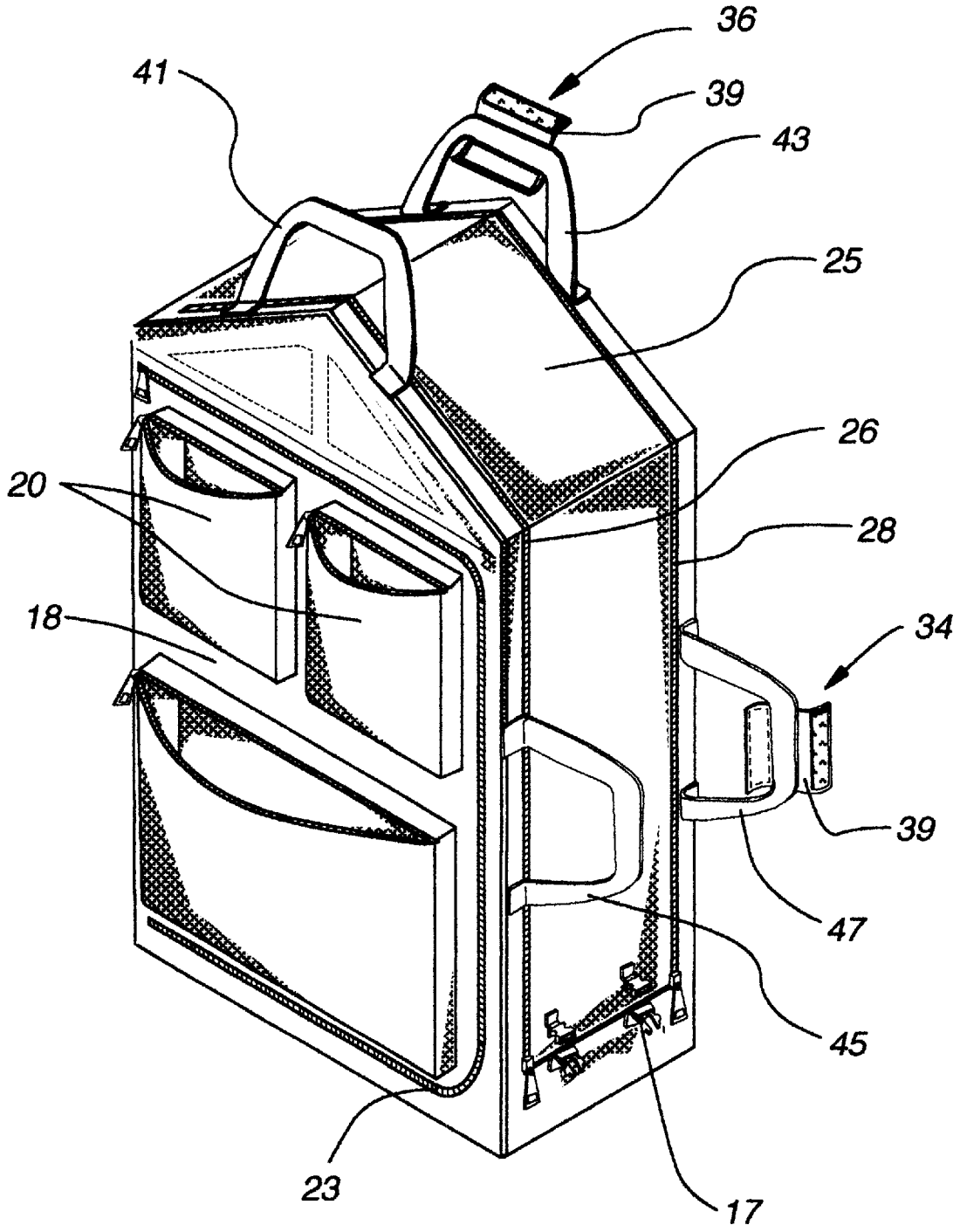
FIG. 3 is an isometric view similar to FIG. 1, but depicts dual-access pockets of the luggage in an open configuration and two-piece handles on the top and right side of the luggage in a configuration that permits opening of a zippered side access panel.

FIG. 3 is an isometric view similar to FIG. 1, but depicts the dual-access, intermediate pockets 20 and the dual-access large bottom pocket 22 in their open configuration. Also, FIG. 3 clearly depicts the upper 36 and lower 34 separable handles in their separated configurations, which permits selective opening of the zippered side access panel 25 for easy access to the interior of the luggage 10. Hook-and-loop tape 39 may be used to hold the front upper handle strap 41 to the rear upper handle strap 43, and to hold the front lower handle strap 45 to the rear lower handle strap 47. The zippered side access panel 25 is shown in its open configuration in, for example, FIGS. 5 and 6. The closure clips 17 are depicted in their disconnected configuration in FIG. 3. If desired, the curved zipper 23 that keeps the zippered front door panel 18 closed could include a lock (not shown) to frustrate people trying to gain quick, unauthorized access to the luggage.

Figure 4:
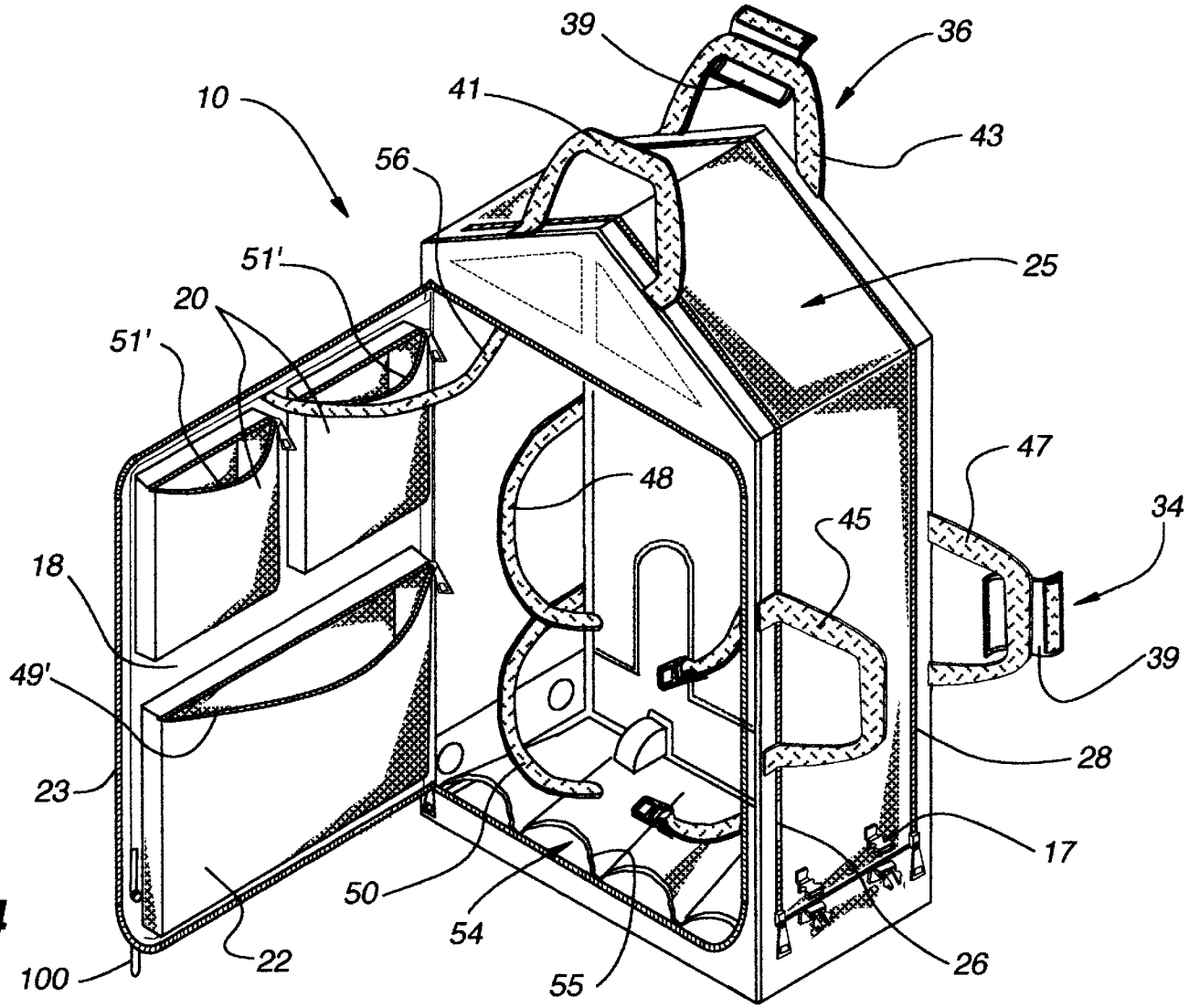
FIG. 4 is an isometric view similar to FIG. 3, but depicts a swing-out front door panel in an open configuration revealing the interior of the luggage and open internal front pockets.

FIG. 4 is an isometric view similar to FIG. 3, but depicts the swing-out front door panel 18 in its open configuration, revealing the interior of the luggage 10. As depicted in FIG. 4, the dual-access intermediate pockets 20 and the dual-access large bottom pocket 22 are open. In the preferred embodiment, the intermediate pockets 20 and the large bottom pocket 22 depicted in, for example, FIGS. 1, 3, and 4 are the same pockets, respectively. Each of these pockets is preferably accessible by either a zipper 49, 51 located on the outer surface of the front door panel 18 or a zipper 49', 51' located on the inner surface of the front door panel 18. An upper cinch strap 48 and a lower cinch strap 50 are fixed to the interior of the luggage 10 to stabilize and retain clothing that is hung from a main hanger bar 52 (FIG. 6) in the luggage. In addition, the interior lower surface of the luggage preferably includes a plurality of shoe sleeves or pockets 54, which may themselves include elastic strips 55 along their forward edges to facilitate retention of shoes in the shoe pockets 54 during shipment and handling. A limiting strap 56 may be present to prevent over opening or extension of the swing-out front door panel 18.

Figure 5:
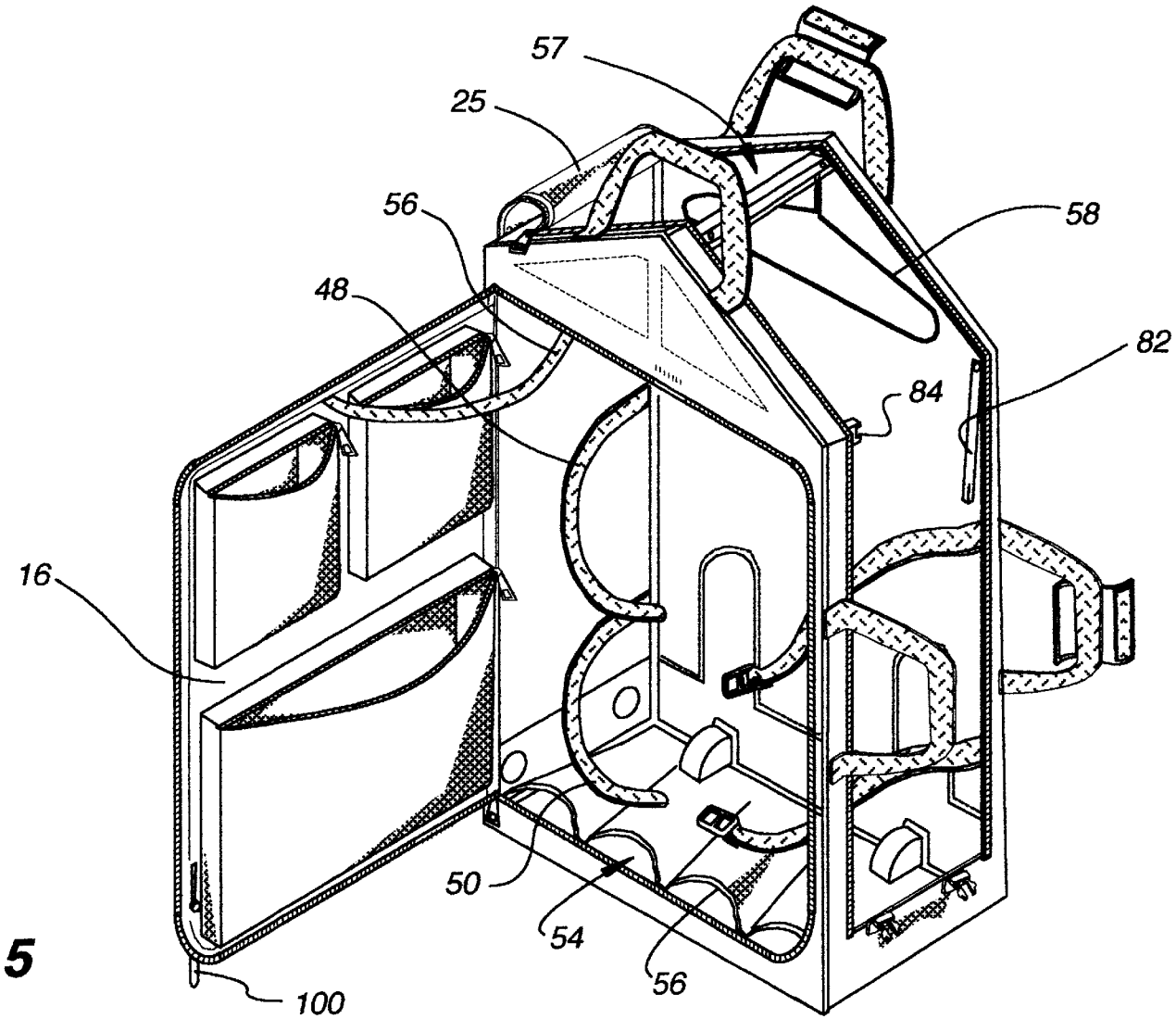
FIG. 5 is an isometric view similar to FIG. 4, but depicts a disconnected zippered side access panel in its fully open configuration and a swingable frame support bar.

FIG. 5 is similar to FIG. 4, but depicts the zippered side access panel 25 in its fully opened configuration, revealing the hanger retention system 57 (see also FIGS. 11 and 12) and the swingable frame support bar 82 comprising part of the present invention. FIG. 6 is an isometric view of the luggage 10 in the configuration depicted in FIG. 5, but showing the rear of the luggage. In this latter figure, hangers 58 are shown on the main hanger bar 52 and the auxiliary hanger bar 44, which is depicted in its fully-extended configuration. In this fully-extended configuration, the head or end of the auxiliary hanger bar 44 is extended from the main hanger bar 52 as discussed more fully below in connection with FIGS. 11–13. The single-access, interior pockets 24, which are shown in phantom in FIGS. 1 and 3–5, for example, are clearly visible in FIG. 6. As depicted in FIG. 6, these single-access interior pockets 24 may be accessed by zipping and unzipping access zippers 53. It should be noted that, although all of the pockets 20, 22, 24 are zipper closed in the preferred embodiments disclosed herein, whether single access or dual access, other techniques for closing these pockets could be used (e.g., button-secured or snap-secured flaps). In the preferred embodiment, hook-and-loop tape 62 is present on the inside surface of the zippered access panel 25 so that the access panel can be retained in a compact and neat and tidy configuration.

Figure 7:
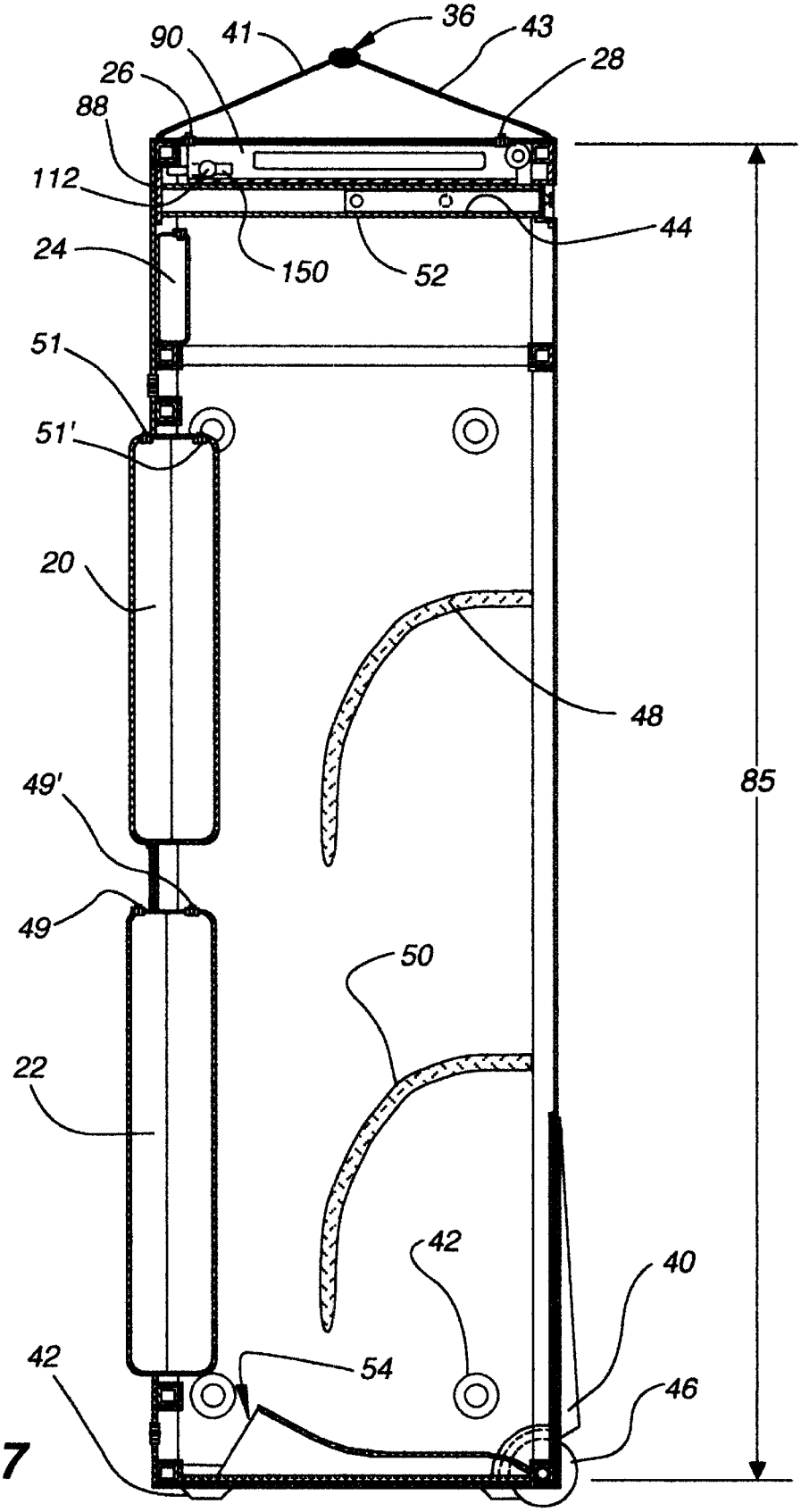
FIG. 7 is a cross-sectional view taken along line 7—7 of FIG. 1.

FIG. 7 is a cross-sectional view taken along line 7—7 of FIG. 1. As shown in the top of FIG. 7, the upper separable handle 36 is depicted under upward tension in its connected configuration. A portion of each of the front closure zipper 26 and the rear closure zipper 28 for the zippered side access panel 25 are visible. FIG. 7 best illustrates the dual-access intermediate pocket 20 and large bottom pocket 22 and the single-access interior pockets 24. As also shown to best advantage in FIG. 7, the intermediate pockets 20 and the bottom pocket 22 project above and below the swingable door panel 18, toward the outside and inside of the luggage 10.

Referring next to FIGS. 8–10, the main frame assembly or support skeleton 94 that comprises part of the luggage 10 according to the present invention is described next. In the preferred embodiment, the main frame assembly 94 is constructed from hollow metal or lightweight composite material having a square cross section, about one inch by one inch. FIG. 8 is an isometric view looking downwardly at the top, front, and right side of the main frame assembly 94 that comprises part of the luggage 10 according to the first embodiment of the present invention. As shown in this figure, the main frame assembly includes a front frame member 30 and a rear frame member 32. The front frame member 30 is outlined by two vertical frame members 64, a lower horizontal frame member 66, and two sloped frame members 68. As mentioned above, the outer periphery of the front frame member 30 is preferably pentagonal or house-shaped. An upper horizontal frame member 69 connects the upper ends of the vertical frame members 64 and the lower ends of the sloped frame members 68. The front frame member 30 could be made from connected components, or it could be a single unitized construction.

The rear frame member 32 depicted in FIG. 8 is constructed much like the front frame member 30, which simplifies manufacturing and assembly. The lower horizontal frame member of the rear frame member 32 is, however, modified to accommodate an axle 70 and a pair of wheels 46 (FIG. 8B). In particular, rather than having one long horizontal frame member like horizontal frame member 66 connecting the lower ends of the two vertical frame members 64 comprising part of the rear frame member 32, two short horizontal frame members 74 extend inwardly from the lower ends of the vertical frame members 64, and the axle 70 spans the gap between these short horizontal frame members 74. As shown to best advantage in FIG. 8A, the ends of the axle 70 are preferably insertable into a hollow portion of the short horizontal frame members 74. An axle retention screw 76 may be used to position and retain the axle 70 in the short horizontal frame members 74. Before the axle 70 is installed, however, a pair of wheels 46 are first mounted on the axle 70. These wheels 46 may be mounted on roller bearings 78 that are themselves pressed onto or frictionally engaged with the axle 70.

In the preferred embodiment, three fixed frame support bars 80 and one swingable frame support bar 82, all of which are clearly visible in FIG. 8, connect the front frame member 30 to the rear frame member 32. Preferably, the fixed and swingable frame support bars 80, 82, respectively, space the vertical plane that contains the front frame member 30 from the vertical plane that contains the rear frame member 32 by approximately twelve inches (the depth 83 of the luggage), which is sufficient to accommodate a man's shoe since the shoe sleeves 54 (FIGS. 4 and 5) preferably extend the full depth of the bottom panel. A support bar catch 84 (see also FIGS. 14 and 15) is mounted at the intersection of one sloped frame member 68, the upper horizontal frame member 69, and one of the vertical frame members 64 comprising part of the front frame member 30. As described further below in connection with FIGS. 14 and 15, this support bar catch 84 releasably retains the distal, free end of the swingable frame support bar 82, which has its opposite, mounted end pivotally attached at a support bar mount 86 located on the rear frame member 32 at a location that corresponds to the mounting location of the support bar catch 84 on the front frame member 30. The distance 85 (FIG. 7) from the bottom to the top of the luggage is the height of the luggage, and the distance 87 (FIG. 8) from the left side to the right side of the luggage is the width of the luggage. This version of the luggage is preferably tall enough that the traveler can easily drag the luggage on its wheels from location to location without having to first extend a handle. If an extendable handle is unnecessary, the construction and use of the luggage is simplified. The height of the luggage is preferably short enough, however, that the luggage will fit in the trunk of most automobiles. Since much of the weight will generally be accumulated in the lower portion of the luggage, the luggage should be easily wheelable from location to location and not top heavy.

Continuing to refer primarily to FIGS. 8–10, the main hanger bar 52 also extends between and connects the front frame member 30 to the rear frame member 32. In the preferred embodiment, a front hanger bar support plate 88 supports a forward end of the main hanger bar 52, and a rear hanger bar support plate 89 supports a rear end of the main hanger bar 52. As described in more detail below in connection with FIGS. 11–14, the swingable hanger retainer or clamp 90 is pivotally connected to the rear hanger bar support plate 89. The auxiliary hanger bar 44 is also depicted in its extended configuration in FIG. 8. The auxiliary hanger bar 44 is important for several reasons. For example, while a traveler is packing the luggage 10, the traveler may temporarily place clothing on the auxiliary hanger bar 44 as the traveler decides what clothing is appropriate for the particular trip. When the traveler determines that a particular item of clothing is necessary for the trip, the clothing can be moved onto the main hanger bar 52. Upon arrival at the destination, the traveler can hang the clothes in which they traveled on the auxiliary hanger bar 44. Thus, clothing that may need to air out can be both neatly organized and kept separate from the remaining clothing on the main hanger bar 52. This ability to separate clothing between the main hanger bar 52 and the auxiliary hanger bar 44 can be useful for several reasons. The traveler may want to hang selected clothing for a particular evening on the auxiliary hanger bar 44. Similarly, if the traveler were to send out shirts for cleaning, for example, the returned, laundered shirts could be temporarily separated from the other clothing by placing these clean shirts on the auxiliary hanger bar 44. Alternatively, clothing that is in need of laundering or pressing may be separated from the other items by placing it on the auxiliary hanger bar 44. The auxiliary hanger bar 44 thus can serve as a staging area for both inbound and outbound clothing. Further, with the main hanger bar 52 and the auxiliary hanger bar 44 being fully accessible when the side access panel 25 is in an opened configuration, the traveler does not need a closet. The auxiliary hanger bar 44 also provides a place for the traveler to inventory clothing.

A front door frame 92, which ultimately supports the intermediate pockets 20 and the large bottom pocket 22 when the fabric or skin is placed onto the main frame assembly 94, is depicted in FIG. 8. In the preferred embodiment, the front door frame 92 comprises a C-shaped front frame member 96 connected to a vertical door frame member 97. The vertical door frame member 97 of the front door frame 92 is swingably attached to one of the vertical frame members 64 comprising part of the front frame member 30 by a piano hinge 98, as is clearly shown in FIG. 10. FIG. 10 is a fragmentary, cross-sectional view taken along line 10—10 of FIG. 8. Finally, FIG. 8 also shows an extendable foot or door supporter 100 that is described in further detail below in connection with FIGS. 16–19.

FIG. 9 is an isometric view of a molded component 38 that comprises part of the luggage 10 according to the present invention. As shown in FIG. 9, this molded component 38 may include a plurality of molded feet 42. The preferred embodiment of the molded component 38 includes a plurality of molded-in feet 42 on two different surfaces. Thus, the luggage 10 may be oriented as shown in, for example, FIG. 1, in which case the luggage 10 would be sitting on the wheels 46 and the two molded feet 42 shown in the horizontal portion of the molded component 38 as depicted in FIG. 9. Alternatively, the luggage 10 could be laid on its left side 37 (FIG. 2), in which case it would rest on the four molded feet 42 shown in the vertical portion of the molded component 38 as depicted in FIG. 9. The skids 40 (see also FIGS. 2 and 6) help protect the rear 35 (FIG. 2) of the luggage 10 from damage when the luggage 10 is laid on its rear side or when the luggage 10 is, for example, pulled up the face of a curb from street level onto a sidewalk. A pair of molded-in wheel cavities 102 are also depicted in FIG. 9. These pre-formed wheel cavities 102 permit the wheels 46 to be mounted with their axes of rotation co-linear with the short horizontal frame members 74 comprising part of the rear frame member 32, which results in the partially tucked away configuration depicted to good advantage in FIGS. 2 and 6. The molded component 38 thus provides some structural integrity while also protecting the outer skin or fabric.

Figure 11:
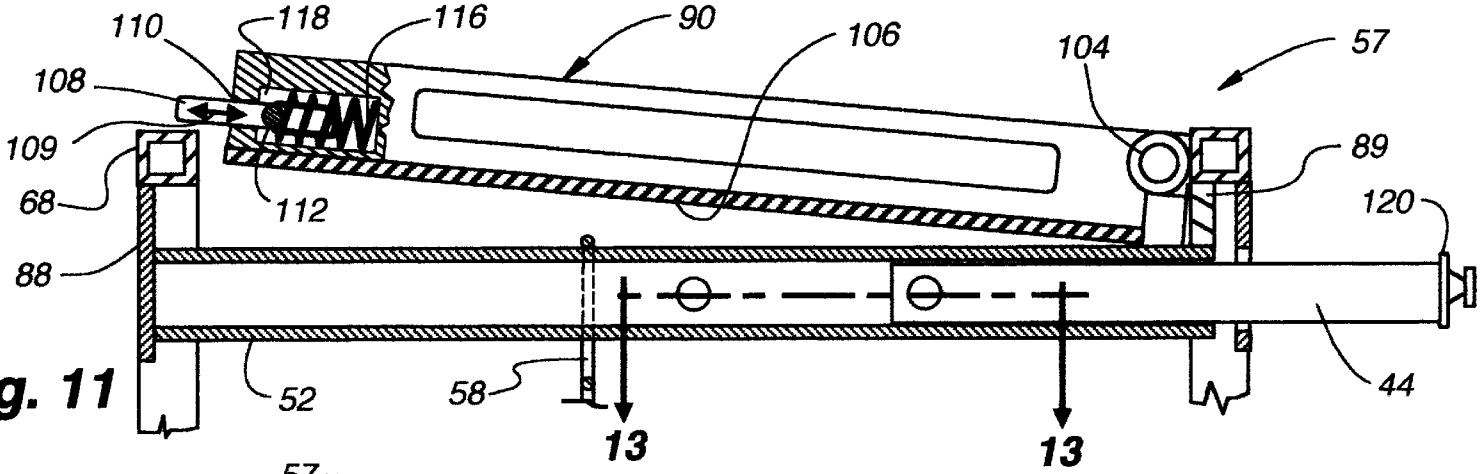
FIG. 11 is an enlarged, fragmentary, cross-sectional view taken along line 11—11 of FIG. 8 and depicting a swingable hanger retainer pivotally mounted above a main hanger bar and the auxiliary hanger bar, wherein the hanger retainer is shown in an open configuration.

Referring next most specifically to FIGS. 11–14, the swingable hanger retainer or clamp 90 and its operation are described next. In the preferred form of the present invention, hangers 58 (see also FIGS. 5 and 6) may be supported along the main hanger bar 52. To permit use of standard hangers 58 while inhibiting these hangers from inadvertently becoming dislodged from the main hanger bar 52, a swingable hanger retainer 90 is provided. In the preferred embodiment, this swingable hanger retainer 90 is pivotally connected to the main frame assembly 94 by a pivot pin 104. This pivot pin 104 may be attached to either the joint between the sloped frame members 68 comprising part of the rear frame member 32, as depicted in FIG. 11, or it may be attached to the rear hanger bar support plate 89. In the preferred embodiment, a compressible material 106 (for example, plastic or rubber) is attached along the lower edge of the swingable hanger retainer 90. When the swingable hanger retainer 90 is lowered to its closed configuration (FIG. 12), the compressible member 106 holds the upper portion of the hangers against the main hanger bar 52 to inhibit accidental dislodgement of the hangers 58 from the main hanger bar 52.

Figure 12:
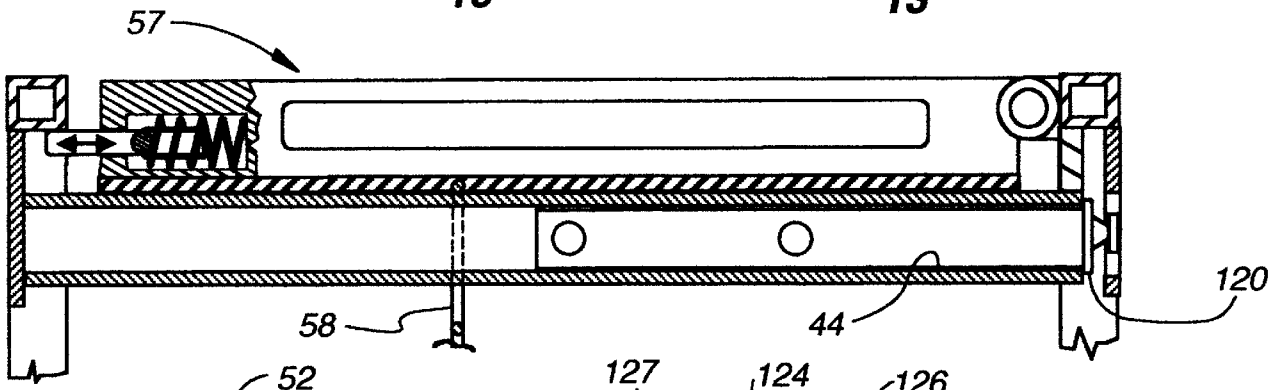
FIG. 12 is similar to FIG. 11, but depicts the hanger retainer in a clamping configuration and the auxiliary hanger bar in a retracted configuration.
Figure 14:
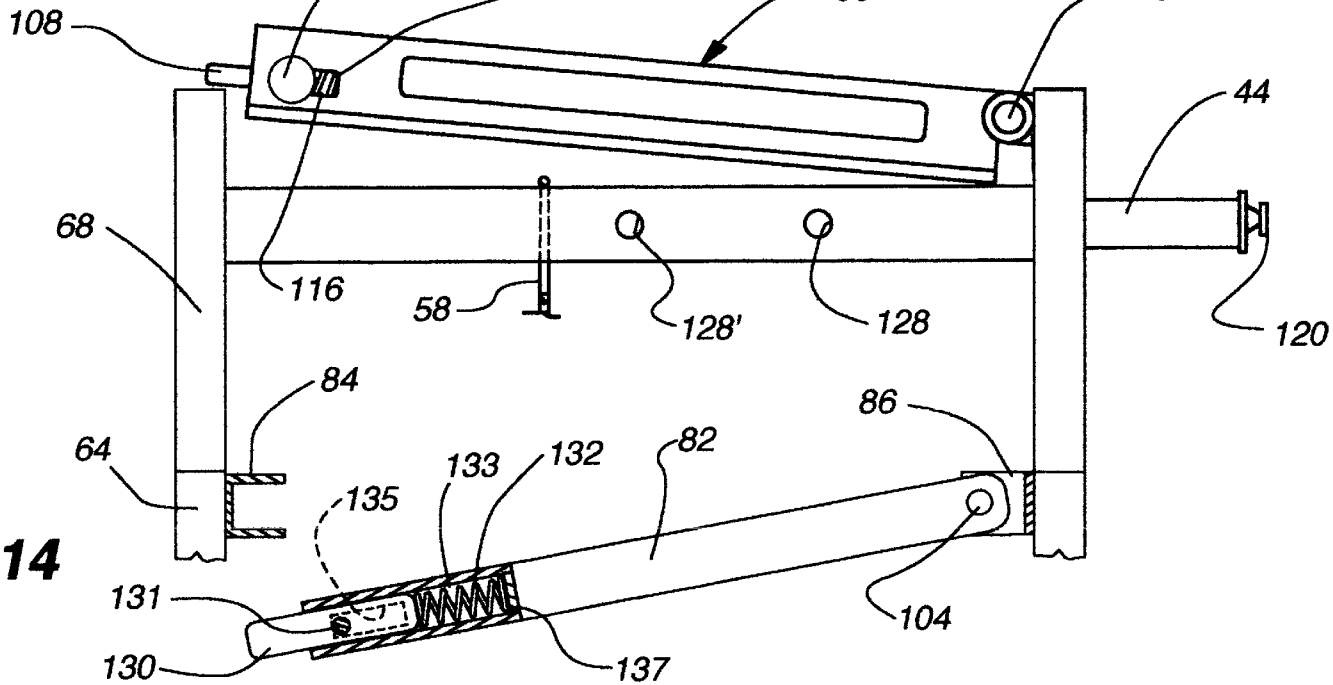
FIG. 14 is an enlarged, fragmentary view in partial cross-section taken along line 14—14 of FIG. 8, and depicting the hanger retainer in an open configuration and the swingable frame support bar in an open configuration.

In order to keep the swingable hanger retainer 90 in its closed configuration (FIG. 12), a swingable hanger retainer closure mechanism is provided. The mechanism includes a slidable, spring-loaded locking pin 108 capable of moving in the back-and-forth direction indicated by arrow 109 through a guide port 110 in one end of the swingable hanger retainer 90. FIGS. 11 and 12 are in partial cross-section to show the slidable locking pin 108 passing through the guide port 110. A thumb projection 112 is mounted to the side of the slidable locking pin 108. This thumb projection 112 rides in a projection guide channel 114 that is visible in FIG. 14. An extension spring 116 is captured in a spring cavity 118 formed in the end of the swingable hanger retainer 90 adjacent to the guide port 110. This extension spring 116 biases the slidable locking pin 108 out of the guide port 110 and away from the free end of the swingable hanger retainer 90. Thus, to move the swingable hanger retainer 90 from its open configuration depicted in FIGS. 11 and 14 to its closed configuration depicted in FIG. 12, a traveler presses the thumb projection 112 rightward in these figures to compress the extension spring 116 in the spring cavity 118 and thereby retracts the slidable locking pin 108. Once the slidable locking pin 108 is sufficiently retracted, the swingable hanger retainer 90 can be lowered to its substantially horizontal and closed configuration depicted in FIG. 12. Upon subsequent release of the pressure holding the thumb projection 112 against the extension spring 116, the slidable locking pin 108 extends outwardly (i.e., leftwardly in FIG. 12) and is retained under the intersection of the two sloped frame members 68 comprising part of the front frame member 30. Although the slidable locking pin and spring arrangement depicted in FIGS. 11, 12, and 14 is used in the preferred embodiment, a variety of different techniques and hardware configurations could be used to retain the swingable hanger retainer 90 in its closed configuration.

Referring to FIGS. 2, 6, 7, 8, and 11–14, the auxiliary hanger bar 44 and its operation are now described in more detail. FIGS. 2 and 12 depict the auxiliary hanger bar 44 in its fully retracted configuration, and FIGS. 6, 7, 8, 11, 13, and 14 depict the auxiliary hanger bar 44 in its fully extended configuration. In the preferred embodiment, the auxiliary hanger bar 44 is designed to extend no more than three inches from the rear side of the luggage 10. Thus, even if a substantial amount of clothing is hung on the fully-extended auxiliary hanger bar 44, the luggage 10 will be unlikely to tip over unless it is otherwise empty. The auxiliary hanger bar 44 includes a retraction stop ring 120 at its distal end. This retraction stop ring 120 serves at least two functions. First, when the auxiliary hanger bar 44 is fully retracted (see, e.g., FIG. 12) the retraction stop ring 120 preferably rests against an end of the main hanger bar 52. This prevents the auxiliary hanger bar 44 from becoming inaccessibly located and possibly lodged within the interior of the main hanger bar 52. Second, as shown in FIG. 6, the retraction stop ring 120 also prevents hangers 58 from inadvertently slipping off the distal end of the auxiliary hanger bar 44 when it is extended. In the preferred embodiment, a recess 122 (FIG. 6) is formed on the rear side of the luggage 10. This recess 122 accommodates the retraction stop ring 120, thereby permitting the rear or inward surface of the retraction stop ring 120 to fully seat against the end of the main hanger bar 52 when the auxiliary hanger bar 44 is fully retracted (see also FIG. 2).

Figure 13:
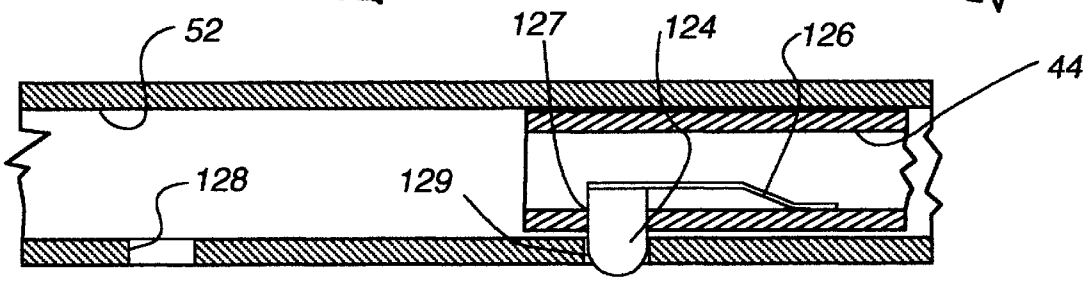
FIG. 13 is a further-enlarged, fragmentary, cross-sectional view taken along line 13—13 of FIG. 11 and depicts a fixation knob used to temporarily fix the position of the ancillary hanger bar in a fully retracted or fully extended configuration.

Referring most specifically to FIGS. 11–13, the mechanism for adjustably fixing the position of the auxiliary hanger bar 44 in either its fully-retracted or its fully-extended configuration is described next. FIG. 13 depicts a fixation knob 124 that is attached to a flexible pressure strip 126 mounted to an inner surface of the auxiliary hanger bar 44. The pressure strip 126 biases the fixation knob 124 through a hole 127 along the circumference of the auxiliary hanger bar 44 and against an inner surface of the main hanger bar 52. In the preferred embodiment, a first knob hole 128 and a second knob hole 129 are provided through the main hanger bar 52. The fixation knob 124 is biased by the pressure strip 126 into the first knob hole 128 when the auxiliary hanger bar is in its fully-retracted configuration. Similarly, when the hanger bar 52 is in its fully-extended configuration, the fixation knob 124 is biased by the pressure strip through the second knob hole 129. Using this hardware assembly that includes the pressure strip 126 and fixation knob 124, the position of the auxiliary hanger bar 44 may be fixably, but adjustably set. This is particularly important when the suitcase is in its travel-ready configuration (see FIGS. 1 and 2). Inadvertent damage to the luggage 10 may result if the auxiliary hanger bar 44 were to unintentionally extend during travel. When the traveler reaches his or her destination, they can press the fixation knob 124 from the first knob hole 128 to free the auxiliary bar 44 so that it may be adjustably extended from the main hanger bar 52. When the fixation knob 124 engages the second knob hole 129, that prevents the auxiliary hanger bar 44 from being inadvertently pulled completely out of the main hanger bar 52.

Referring most particularly to FIGS. 5, 8, 14, and 15, the swingable frame support bar 82 and its operation are described next. As previously described in connection with the main frame assembly 94, the swingable frame support bar 82 is pivotably attached to the rear frame member 32. When a traveler desires easy access to the items being supported by the main hanger bar 52, for example, the zippered side access panel 25 would be in its open configuration (see FIGS. 5 and 6), and the swingable frame support bar 82 would be disengaged from the support bar catch 84 as depicted in FIG. 5. In the preferred embodiment, the swingable frame support bar 82 is disengagably connected to the support bar catch 84 using a locking pin 130 having a thumb projection 131 and extension spring 132 associated with it. The extension spring 132 is captured in a spring cavity 133. The swingable frame support bar retention system is similar to the system that retains the swingable hanger retainer 90 in its closed and clamping configuration.

Figure 15:
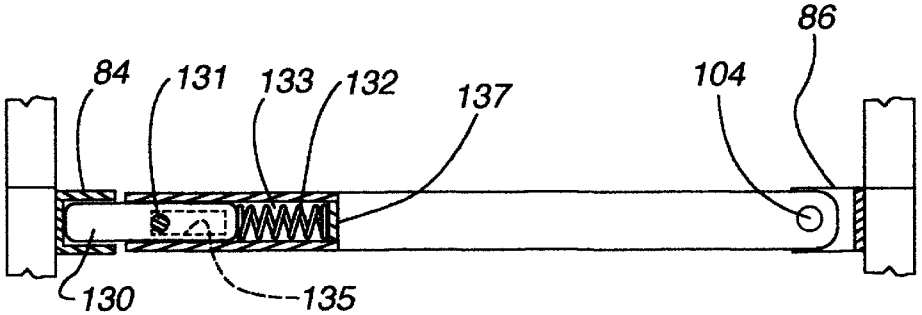
FIG. 15 is an enlarged, fragmentary view in partial cross-section depicting the swingable frame support bar of FIG. 14 in its closed or fully attached and supporting configuration.

Referring most particularly to FIGS. 14 and 15, a traveler desiring to place the luggage 10 in its fully supported configuration for traveling would press the thumb projection 131 rightward in FIG. 14, sliding it in the projection guide channel 135 and thereby compressing the extension spring 132. As shown in FIGS. 14 and 15, the extension spring 132 is trapped between an end of the locking pin 130 and a spring pressure plate 137. With the locking pin 130 in this retracted configuration, the swingable frame support bar 82 can be pivoted about the pivot pin 104, which connects the swingable frame support bar 82 to the swingable support bar mount 86, until the free end of the swingable frame support bar 82 is aligned with the support bar catch 84 mounted to one of the vertical frame members 64 of the front frame member 30. When the swingable frame support bar 82 is in this aligned position and the pressure on the thumb projection 131 is released, the extension spring 132 drives the locking pin 130 into the support bar catch 84, thereby placing the swingable frame support bar 82 in its fully supporting position depicted in FIG. 15. In this position, the swingable frame support bar 82 helps the luggage withstand, for example, a load pressing the front frame member 30 toward the rear frame member 32.

Figure 17:
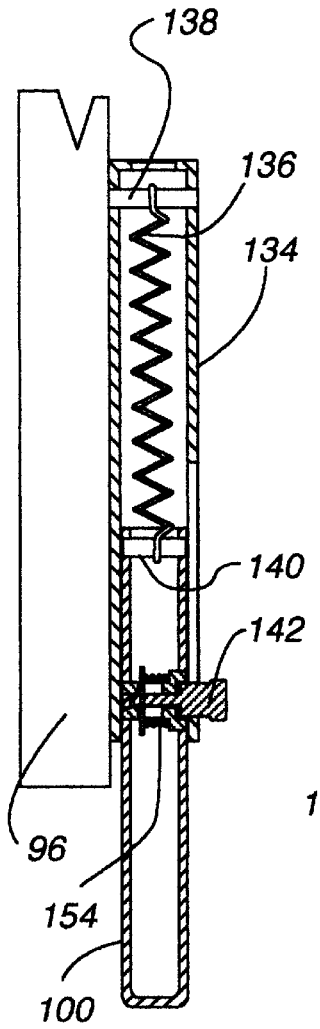
FIG. 17 is an enlarged, fragmentary, cross-sectional view taken along line 17—17 of FIG. 16 and depicting the door supporter in its fully extended configuration.
Figure 16:
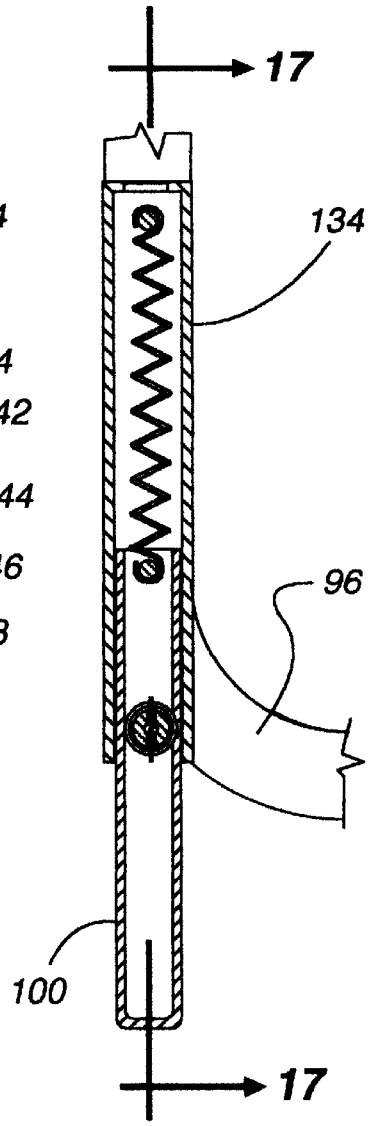
FIG. 16 is an enlarged, fragmentary, cross-sectional view taken along line 16—16 of FIG. 8 through a door supporter and depicting the door supporter in a fully extended configuration.

As shown in FIGS. 4–6, 8, and 16–19, the first preferred embodiment of the present invention may also include the retractable door supporter 100 mounted in a door supporter mounting tube 134. The door supporter 100 includes a mechanism for temporarily fixing the door supporter 100 in its fully-extended configuration (FIGS. 16 and 17). Thus, the door supporter 100 can help keep the swingable front door 18 in a desired position (e.g., fully or partially opened). Also, the door supporter 100 can keep the luggage 10 from inadvertently tipping forward when the swingable door 18 is in the open configuration. For example, if the intermediate pockets 20 and the large bottom pocket 22 contained sufficiently heavy items, the luggage 10 may tend to tip forward on opening the swingable door 18. If the door supporter 100 were, however, in its extended and locked configuration, which is described more fully below, the door supporter 100 itself could help to maintain the luggage 10 in its balanced, upright configuration depicted in many of the drawings. Taking advantage of this self-standing aspect, a traveler may wheel the luggage 10 into the closet for packing. Upon reaching the destination, the traveler can access their clothing without first having to unpack the luggage. In fact, since the clothing in the luggage hangs in an uncompressed and unfolded configuration, there is no need for the traveler to unload the luggage at all. Upon returning from a trip, the traveler may even leave the luggage packed, particularly if the traveler travels frequently. The self-standing aspect thus permits the clothes to remain in an unfolded configuration wherein gravity helps maintain the appearance of the clothing.

Figure 18:
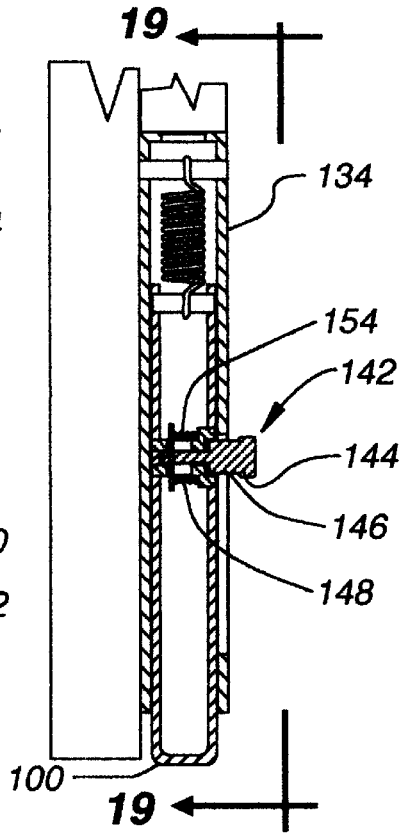
FIG. 18 is similar to FIG. 17, but depicts the door supporter in a fully-retracted configuration.
Figure 19:
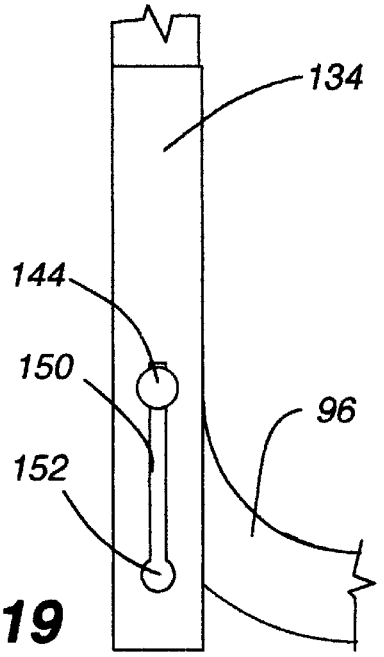
FIG. 19 is an enlarged, fragmentary view taken along line 19—19 of FIG. 18 and depicting the door supporter in its fully-retracted configuration.

Referring most specifically to FIGS. 16–19, the elements comprising the door supporter assembly and their operation are described next. FIG. 16 is an enlarged, fragmentary, cross-sectional view taken along line 16—16 of FIG. 18 through the door supporter 100 and the door supporter mounting tube 134. This figure depicts the door supporter 100 in a fully-extended configuration. FIG. 17 is an enlarged, fragmentary, cross-sectional view taken along line 17—17 of FIG. 16. FIG. 18 is similar to FIG. 17, but depicts the door supporter 100 in a fully-retracted configuration. FIG. 19 is an enlarged, fragmentary view taken along line 19—19 of FIG. 18. The hardware comprising the door supporter assembly includes a retention spring 136, one end of which is connected to an upper mounting pin 138 and the lower end of which is connected to a lower mounting pin 140. The upper mounting pin 138 is fixed relative to the front door frame 92, and the lower mounting pin 140 is fixed relative to the door supporter 100 and movable relative to the upper mounting pin 138. The retention spring 136 biases the door supporter 100 upwardly into its fully-retracted configuration (FIG. 18). A fixation pin 142 having a crown 144, main body 146, and projection 148 cooperates with a projection slip channel 150 that includes expanded lock apertures 152 to temporarily fix the door supporter 100 in its fully-retracted or fully-extended positions. In particular, a fixation pin spring 154 biases the fixation pin 142 toward a position where the main body 146 of the fixation pin 142 is seated in one or the other of the expanded lock apertures 152. Although the projection slip channel 150 of the preferred embodiment has only two expanded lock apertures 152, additional apertures could be present along the projection slip channel 150.

In order to temporarily fix the door supporter 100 in its fully-extended configuration, the fixation pin 142 is pulled rightwardly in FIG. 18. This would compress a fixation pin spring 154 that biases the fixation pin 142 leftwardly in FIGS. 17 and 18. For example, the fixation pin 142 could be pulled by its crown 144, if present, until the main body 146 is free of the expanded aperture 152 at the top of the projection slip channel 150. At that point, once the fixation pin 142 is pulled sufficiently rightwardly in FIG. 18, the projection slippingly rides in the projection slip channel 150. By then applying downward pressure on the fixation pin 142, the door supporter 100 is extended as the fixation pin 142 moves down the projection slip channel 150. As the fixation pin 142 moves along the projection slip channel 150, the back or inward side of the main body 146 slips along an outer surface of the door supporter mounting tube 134 adjacent to the edges of the projection slip channel 150. When the fixation pin 142 gets to the bottom of the projection slip channel 150, its main body 146 slips into a second expanded region or lock aperture 152 at a lower end of the projection slip channel 150. When the rightward pressure on the fixation pin 142 is completely released, the fixation pin spring 154 biases the main body 146 of the fixation pin 142 into the expanded lock aperture 152. The fixation pin 142 thus temporarily hold the door supporter 100 in its fully-extended configuration.

Figure 20:
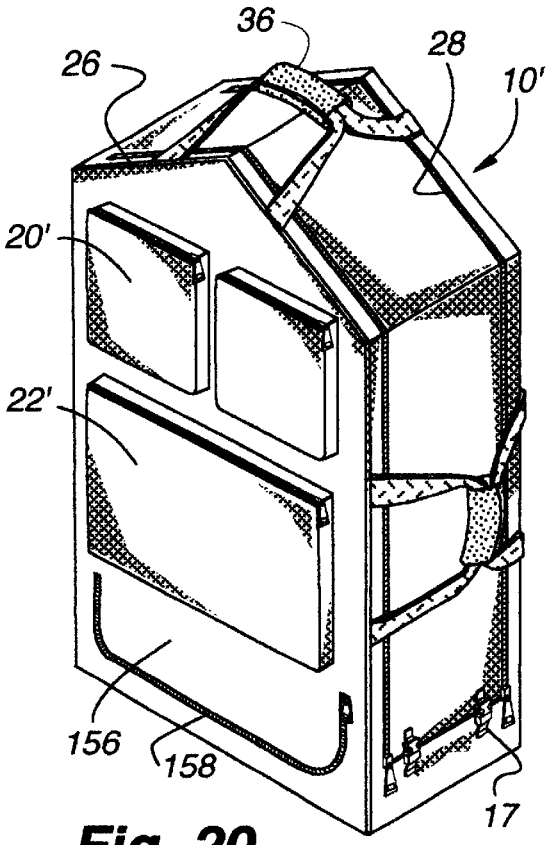
FIG. 20 is similar to FIG. 1 but depicts a second embodiment of the luggage according to the present invention.
Figure 21:
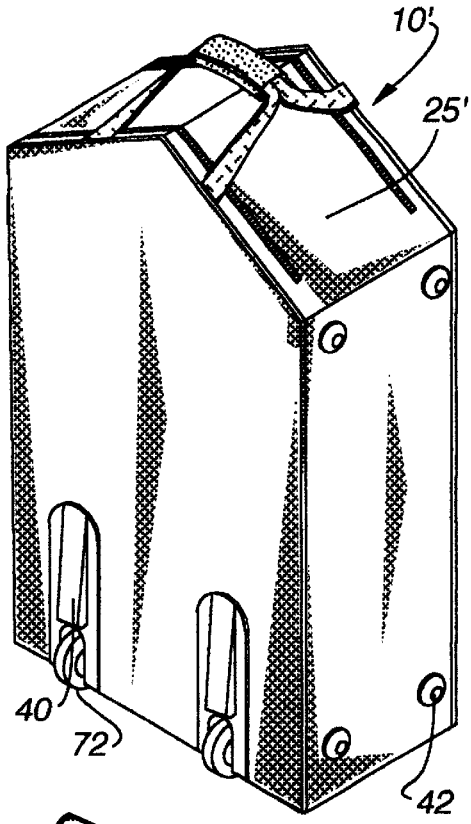
FIG. 21 is similar to FIG. 2, but depicts the second embodiment of the present invention.
Figure 22:
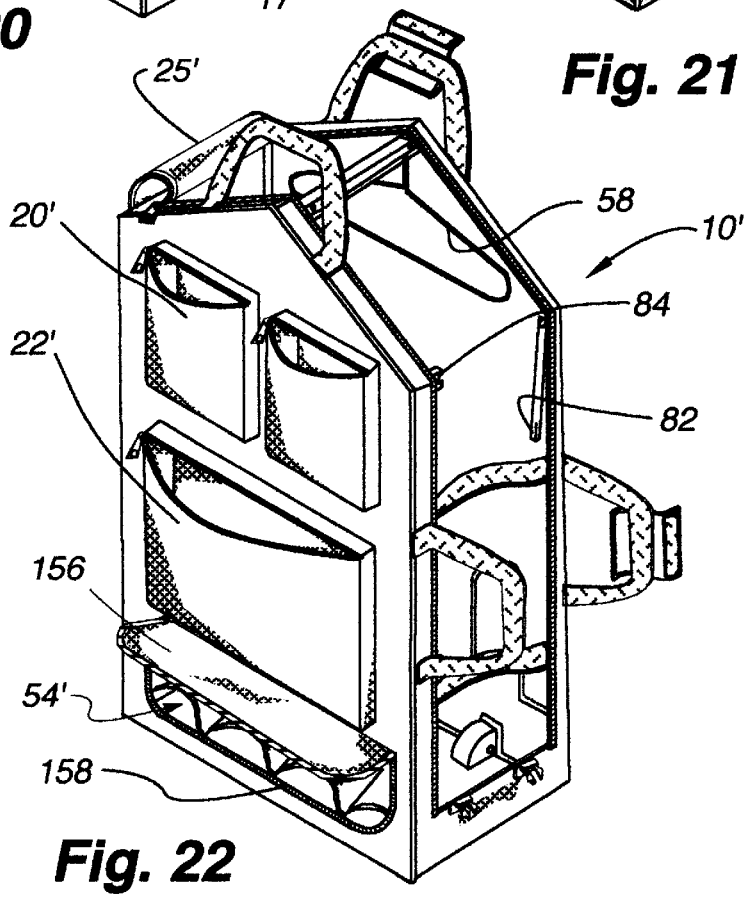
FIG. 22 is most similar to FIG. 5, but depicts the second embodiment of the present invention with all access panels and pockets in their open configuration.

FIGS. 20–22 depict the second preferred embodiment 10' according to the present invention. A primary difference between the second preferred embodiment 10' and the first preferred embodiment 10 is the lack of a swingable front door panel 18 on the second embodiment 10'. This difference between the first and second preferred embodiments drives the need for a shoe access panel 156. The shoe access panel 156, which is held closed by a shoe access panel zipper 158, covers the shoe pockets 54' located along the lower surface of the luggage 10'. Further, in this second preferred embodiment, the single-access, interior pockets 24 (e.g., FIG. 1) are not present. Since the embodiment depicted in FIGS. 20–22 still has a zippered side access panel 25' like the first embodiment, single-access, internal pockets could be used since they could be easily accessed upon opening of the zippered side access panel 25'. The intermediate pockets 20' and the large bottom pocket 22' of the second preferred embodiment are preferably single-access. Again, however, since the zippered side access panel 25' of the second preferred embodiment works the same as the zippered side access panel 25 of the first preferred embodiment, both the intermediate pockets 20' and the large bottom pocket 22' could be dual access in the second preferred embodiment. Since it is contemplated that the second preferred embodiment generally will be smaller than the first preferred embodiment, the auxiliary hanger bar 44 (e.g., FIG. 6) may not be included since the smaller version of the luggage 10' would be more likely to tip over than the larger version if clothing were hung on an auxiliary hanger bar 44. The remaining features of the first preferred embodiment are equally applicable to the second preferred embodiment.

Although two embodiments of this invention have been described above with a certain degree of particularity, those skilled in the art could make numerous alterations to the disclosed embodiments without departing from the spirit or scope of this invention. For example, although the luggage depicted in the figures is pentagonal or house-shaped to match the general outline of a man's or a woman's clothing, other configurations could be used. For example, the upper portions of the front frame member 30 and of the rear frame member 32 could be square or curved as opposed to triangular. Additionally, the main frame assembly 94 could be made from, for example, metal, nylon, plastic, or composite material; and the frame members need not have the substantially square cross-sectional shape that is depicted in the figures. An important feature of this invention is its enhanced clothing and accouterments carrying capabilities and the easy accessability provided by the zippered access panels and swingable doors. All direction references (e.g., upper, lower, upward, downward, left, right, leftwardly, rightwardly, top, bottom, front, and rear) are only used for identification purposes to aid the reader's understanding of the present invention, and do not create limitations, particularly as to the position, orientation, or use of the invention. It is intended that all matter contained in the above description or shown in the accompanying drawings shall be interpreted as demonstrative only and not limiting. Changes in detail or structure may be made without departing from the spirit of the invention as defined in the appended claims.

I claim:

1. A piece of luggage for carrying clothing and accessories, said luggage having an interior and comprising a main frame assembly comprising a front frame member, a rear frame member, a main hanger bar extending between said front frame member and said rear frame member, a swingable frame support bar extending between said front frame member and said rear frame member, said swingable frame support bar being adapted to pivot between an open configuration and a supporting configuration, and a swing-out front door panel supported on a front door frame, said swing-out front door panel being adapted to swing between a closed configuration and an open configuration;

a hanger retention system connected to said main frame assembly adjacent to said main hanger bar; and an outer skin supported on said main frame assembly, said outer skin comprising a side access panel that is transformable between an open configuration and a closed configuration.

2. The piece of luggage according to claim 1, wherein a door zipper keeps said front door panel in said closed configuration.

3. The piece of luggage according to claim 2, wherein said door zipper is a single curved zipper.

4. The piece of luggage according to claim 1, wherein said swing-out front door panel further comprises two intermediate pockets and one large bottom pocket.

5. The piece of luggage according to claim 4, wherein each of said two intermediate pockets and said one large bottom pocket is a dual-access pocket.

6. The piece of luggage according to claim 1, wherein said front frame member further comprises a first front vertical frame member, wherein said front door frame further comprises a C-shaped front frame member connected to a vertical door frame member, and wherein said vertical door frame member is swingably attached to said first front vertical frame member.

7. The piece of luggage according to claim 6, wherein a piano hinge swingably attaches said vertical door frame member to said first front vertical frame member.

8. The piece of luggage according to claim 1, the luggage further comprising an auxiliary hanger bar adapted to move between a retracted configuration and an extended configuration.

9. The piece of luggage according to claim 8, the luggage further comprising a positioning means for adjustably fixing a position of said auxiliary hanger bar in at least one of said retracted configuration and said extended configuration.

10. The piece of luggage according to claim 9, wherein said auxiliary hanger bar has an inner surface and an outer surface, and wherein said positioning means further comprises a flexible pressure strip mounted to said inner surface of said auxiliary hanger bar;

a fixation knob attache d to said flexible pressure strip and projectin g through a hole from said inner surface to said outer surface of said auxiliary hanger bar and toward an inner surface of said main hanger bar, said fixation knob being adapted to temporarily fix a position of said ancillary hanger bar in at least one of said retracted configuration and said extended configuration; and a first knob hole and a second knob hole through said main hanger bar.

11. The piece of luggage according to claim 9, wherein said auxiliary hanger bar further comprises a re traction stop ring at a distal end of said auxiliary hanger bar, and further wherein a recess is formed on a rear side of the luggage, said recess being adapted to accommodates said retraction stop ring.

12. The piece of luggage according to claim 11, said luggage further comprising a door supporter assembly.

13. The piece of luggage according to claim 12, wherein said door supporter assembly further comprises a retractable do or supporter adapted to move between a retracted configuration and an extended configuration; and a fixing means for temporarily fixing said retractable door supporter in said extended configuration.

14. The piece of luggage according to claim 12, wherein said fixing means further comprises a door supporter mounting tube in which said retractable door supported is adapted to move, said door supported mounting tube having a projection slip channel extending longitudinally along a surface of said mounting tube, wherein at least one lock aperture is present along said slip channel;

a retention spring arranged to bias said door supporter into said retracted configuration;

a fixation pin having a main body; and a fixation pin spring that biases said main body of said fixation pin into engagement with said at least one lock aperture along said projection slip channel.

15. The piece of luggage according to claim 14, wherein said fixing fin further comprises a crown and a projection, and wherein said projection is adapted to ride in said projection slip channel at least during adjustment of said door supporter.

16. The piece of luggage according to claim 14, wherein said at least one lock aperture comprises a first lock aperture at a top end of said projection slip channel and a second lock aperture at a bottom end of said projection slip channel.

17. The piece of luggage according to claim 14, wherein said retention spring has a first end that is connected to an upper mounting pin and a second end that is connected to a lower mounting pin, wherein said upper mounting pin is fixed relative to said front door frame, and said lower mounting pin is fixed relative to said door supporter and movable relative to said upper mounting pin.

18. A piece of luggage for carrying clothing and accessories, said luggage having an interior and comprising a main frame assembly comprising a plurality of frame members, a main hanger bar, and a swingable frame support bar adapted to pivot between an open configuration and a supporting configuration;

a hanger retention system connected to said main frame assembly;

an outer skin supported on said main frame assembly, said outer skin comprising a front panel;

a side access panel comprising part of said outer skin and transformable between an open configuration and a closed configuration; and a plurality of dual-access pockets, including two intermediate pockets and one large bottom pocket, wherein each of said plurality of dual-access pockets is preferably accessible by an outer zipper located on an outer surface of said front panel and an inner zipper located on an inner surface of said front panel.

19. The piece of luggage according to claim 18, wherein said plurality of pockets further includes at least one single-access internal front pocket.

20. The piece of luggage according to claim 19, wherein said at least one single-access internal front pocket comprises two single-access internal pockets, each closed by an access zipper.

21. A piece of luggage for carrying clothing and accessories, said luggage having an interior and comprising a main frame assembly comprising a plurality of frame members, a main hanger bar, and a swingable frame support bar adapted to pivot between an open configuration and a supporting configuration;

a hanger retention system connected to said main frame assembly;

an outer skin supported on said main fame assembly, said outer skin comprising a front panel;

a side access panel comprising part of said outer skin and transformable between an open configuration and a closed configuration; and a first separable handle on a top surface of said luggage; and a second separable handle on a side surface of said luggage, wherein said first and second separable handles are two-piece handles.

22. A piece of luggage for carrying clothing and accessories, said luggage having an interior and comprising a main frame assembly comprising a plurality of frame members, a main hanger bar, and a swingable frame support bar adapted to pivot between an open configuration and a supporting configuration, wherein said main frame assembly further comprises a front frame member and a rear frame member, and wherein said front frame member further comprises a first front vertical frame member having a first upper end and a first lower end;

a second front vertical frame member having a second upper end and a second lower end;

a first front sloped frame member having a first upper end and a first lower end, wherein said first lower end of said first front sloped frame member is connected to said first upper end of said first front vertical frame member;

a second front sloped frame member having a second upper end and a second lower end, wherein said second lower end of said second front sloped frame member is connected to said second upper end of said second front vertical frame member, and wherein said second upper end of said second front sloped frame member is connected to said first upper end of said first front sloped frame member; and a front lower horizontal frame member having a first end and a second end, wherein said first end of said front lower horizontal frame member is connected to said first lower end of said first front vertical frame member, and wherein said second end of said front lower horizontal frame member is connected to said second lower end of said second front vertical frame member;

a hanger retention system connected to said main frame assembly;

an outer skin supported on said main frame assembly, said outer skin comprising a front panel; and a side access panel comprising part of said outer skin and transformable between an open configuration and a closed configuration.

23. The piece of luggage according to claim 22, wherein said front frame member further comprises a front upper horizontal frame member having a first end and a second end, wherein said first end of said front upper horizontal frame member is connected to at least one of said first upper end of said first front vertical frame member and said first lower end of said first front sloped frame member, and wherein said second end of said front upper horizontal frame member is connected to at least one of said second upper end of said second front vertical frame member and said second lower end of said second front sloped frame member.

24. The piece of luggage according to claim 22, wherein said rear frame member further comprises a first rear vertical frame member having a first upper end and a first lower end;

a second rear vertical frame member having a second upper end and a second lower end;

a first rear sloped frame member having a first upper end and a first lower end, wherein said first lower end of said first rear loped frame member is connected to said first upper end of said first rear vertical frame member;

a second rear sloped frame member having a second upper end and a second lower end, wherein said second lower end of sad second rear sloped frame member is connected to said second upper end of said second re vertical frame member, and wherein said second upper end of said second rear sloped frame member is connected to said first upper end of said first rear sloped frame member;

a first short horizontal frame member having a first end and a second end, wherein said first end of said first short horizontal frame member is connected to said first lower end of said first rear vertical frame member;

a second short horizontal frame member having a first end and a second end, wherein said first end of said second short horizontal frame member is connected to said second lower end of said second rear vertical frame member; and a connecting frame member connected between said second end of said first short horizontal frame member and said second of said second short horizontal frame member.

25. The piece of luggage according to claim 24, wherein said rear frame member further comprises a rear upper horizontal frame member having a first end and a second end, wherein said first end of said rear upper horizontal frame member is connected to at least one of said first upper end of said first rear vertical frame member and said first lower end of said first rear sloped frame member, and wherein said second end of said rear upper horizontal frame member is connected to at least one of said second upper end of said second rear vertical frame member and said second lower end of said second rear sloped frame member.

26. The piece of luggage according to claim 24, wherein said connecting frame member is a wheel axle that spans between said first and second short horizontal frame members.

27. The piece of luggage according to claim 26, wherein a pair of wheels are rotatably mounted on said wheel axle.

28. The piece of luggage according to claim 24, wherein said main frame assembly further comprises a plurality of fixed frame support bars connecting said front frame member to said rear frame member.

29. The piece of luggage according to claim 28, wherein said plurality of fixed frame support bars comprises three fixed frame support bars.

30. The piece of luggage according to claim 29, wherein each of said plurality of fixed frame support bars is twelve inches long.

31. The piece of luggage according to claim 29, wherein said swingable frame support bar has a free end and a mounted end, wherein said free end has a locking mechanism disengagably connectable to a support bar catch adapted to releasably retains said free end of said swingable frame support bar and affixed to a catch location on said front frame member, and wherein said mounted end is pivotally attached to a swingable support bar mount affixed to a pivot location on said rear frame member, wherein said pivot location corresponds to said catch location.

32. The piece of luggage according to claim 31, wherein said mounted end of said swingable frame support bar is pivotally attached by a pivot pin.

33. The piece of luggage according to claim 31, wherein said locking mechanism further comprises a locking pin, wherein a thumb projection extends from said locking pin, and further wherein an extension spring pressingly engages said locking pin.

34. The piece of luggage according to claim 31, wherein said support bar catch is mounted to one of said first and second front vertical frame members of said front frame member.

35. The piece of luggage according to claim 34, wherein said support bar catch is mounted at an intersection of one of said first and second front sloped frame members and a corresponding one of said first and second front vertical frame members comprising part of said front frame member.

36. The piece of luggage according to claim 31, wherein said locking mechanism further comprises a locking pin having a thumb projection;

a projection guide channel adapted to slippingly accommodate said thumb projection; and an extension spring captured in a spring cavity between an end of said locking pin and a spring pressure plate.

37. The piece of luggage according to claim 24, wherein said main frame assembly is a unibody construction.

38. The piece of luggage according to claim 24, wherein said main frame assembly is constructed from hollow metal having a square cross section.

39. The piece of luggage according to claim 24, wherein said main frame assembly is constructed from composite material having a square cross section.

40. The piece of luggage according to claim 38 or 39, wherein said square cross section of said main frame assembly is one inch by one inch.

41. A piece of luggage for carrying clothing and accessories, said luggage having an interior and comprising a main frame assembly comprising a plurality of frame members, a main hanger bar, and a swingable frame support bar adapted to pivot between an open configuration and a supporting configuration, wherein said main frame assembly further comprises a front frame member and a rear frame member, and wherein said main hanger bar extends between said front frame member and said rear frame member;

a hanger retention system connected to said main frame assembly;

an outer skin supported on said main frame assembly, said outer skin comprising a front panel; and a side access panel comprising part of said outer skin and transfomable between an open configuration and a closed configuration.

42. The piece of luggage according to claim 41, herein said main hanger bar connects said front frame member to said rear frame member.

43. The piece of luggage according to claim 42, wherein said main hanger bar has a forward end and a rearward end, and wherein said luggage further comprises a front hanger bar support plate that supports said forward end of said main hanger bar; and a rear hanger bar support plate that supports said rear end of said main hanger bar.

44. The piece of luggage according to claim 43, wherein said hanger retention system further comprises a swingable hanger retainer pivotally connected to said rear hanger bar support plate adjacent to said main hanger bar, said swingable hanger retainer being adapted to pivot between an open configuration and a clamping configuration.

45. The piece of luggage according to claim 41, wherein said hanger retention system further comprises a swingable hanger retainer pivotally mounted to said main frame assembly adjacent to said main hanger bar and adapted to pivot between an open configuration and a clamping configuration.

46. The piece of luggage according to claim 45, wherein said swingable hanger retainer is pivotally mounted above said main hanger bar.

47. The piece of luggage according to claim 46, wherein said rear frame member further comprises a first rear sloped frame member having a first upper end; and a second rear sloped frame member having a second upper end, wherein said second upper end of said second rear sloped frame member is connected to said first upper end of said first rear sloped frame member; and wherein said swingable hanger retainer is pivotally mounted to said rear main frame member by a pivot pin attached adjacent to said first upper end of said first rear sloped frame member and said second upper end of said second rear sloped frame member.

48. The piece of luggage according to claim 45, wherein said swingable hanger retainer has a lower edge and wherein said swingable hanger retainer further comprises a compressible material attached along said lower edge.

49. The piece of luggage according to claim 45, wherein said hanger retention system further comprises a swingable hanger retainer closure mechanism.

50. The piece of luggage according to claim 49, wherein said swingable hanger retainer closure mechanism comprises a slidable locking pin adapted to move back-and-forth through a guide port in a free end of said swingable hanger retainer between an extended configuration and a retracted configuration.

51. The piece of luggage according to claim 50, wherein said swingable hanger retainer closure mechanism further comprises an extension spring captured in a spring cavity adjacent to said guide port at said free end of said swingable hanger retainer, said extension spring being adapted to bias said slidable locking pin out of said guide port and away from said free end of said swingable hanger retainer and into said extended configuration.

52. The piece of luggage according to claim 50, wherein said swingable hanger retainer closure mechanism further comprises a thumb projection mounted to a side of said slidable locking pin, said thumb projection riding in a projection guide channel formed adjacent to said free end of said swingable hanger retainer.

53. A piece of luggage for carrying clothing and accessories, said luggage having an interior and comprising a main frame assembly comprising a plurality of frame members, a main hanger bar, and a swingable frame support bar adapted to pivot between an open configuration and a supporting configuration;

a hanger retention system connected to said main frame assembly;

an outer skin supported on said main frame assembly, said outer skin comprising a front panel; and a side access panel comprising part of said outer skin and transformable between an open configuration and a closed configuration, wherein at least one closure zipper keeps said side access panel in said closed configuration, wherein said at least one closure zipper comprises a pair of zippers, including a front closure zipper and a rear closure zipper.

54. The piece of luggage according to claim 53, wherein said side access panel has a distal end, and wherein at least one closure clip is adapted to secure said distal end of said side access panel in said closed configuration.

55. A piece of luggage for carrying clothing and accessories, said luggage having an interior and comprising a main frame assembly comprising a plurality of frame members, a main hanger bar, and a swingable frame support bar adapted to pivot between an open configuration and a supporting configuration;

a hanger retention system connected to said main frame assembly;

an outer skin supported on said main frame assembly, said outer skin comprising a front panel;

a side access panel comprising part of said outer skin and transformable between an open configuration and a closed configuration; and a plurality of shoe sleeves on a bottom panel in the interior of the luggage, wherein said bottom panel has a depth, wherein said plurality of shoe sleeves have forward edges and extend the depth of said bottom panel, and wherein said plurality of shoe sleeves further include elastic strips along said forward edges.

56. A piece of luggage for carrying clothing and accessories, said luggage having an interior and comprising a main frame assembly comprising a plurality of frame members, a main hanger bar, and a swingable frame support bar adapted to pivot between an open configuration and a supporting configuration;

a hanger retention system connected to said main frame assembly;

an outer skin supported on said main frame assembly, said outer skin comprising a front panel; and a side access panel comprising part of said outer skin and transformable between an open configuration and a closed configuration, wherein at least one closure zipper keeps said side access panel in said closed configuration, wherein said side access panel has an inside surface, and wherein hook-and-loop tape is mounted on said inside surface of said side access panel.

57. A piece of luggage for carrying clothing and accessories, said luggage having an interior and comprising a main frame assembly comprising a plurality of frame members, a main hanger bar, and a swingable frame support bar adapted to pivot between an open configuration and a supporting configuration;

a hanger retention system connected to said main frame assembly;

an outer skin supported on said main frame assembly, said outer skin comprising a front panel;

a side access panel comprising part of said outer skin and transformable between an open configuration and a closed configuration; and a molded component protecting at least a portion of said outer skin, said molded component comprising at least one skid on a rear side of the luggage;

a plurality of molded feet that project outwardly from at least one side of the luggage; and a pair of molded-in wheel cavities.

* * * * *